US010269336B2

(12) United States Patent
Lin et al.

(10) Patent No.: US 10,269,336 B2
(45) Date of Patent: Apr. 23, 2019

(54) ARRANGEMENT AND FIELD DEVICE OF PROCESS MEASUREMENTS TECHNOLOGY

(71) Applicant: Endress + Hauser Flowtec AG, Reinach (CH)

(72) Inventors: Yaoying Lin, Freising (DE); Alfred Rieder, Landshut (DE); Wolfgang Drahm, Erding (DE); Michal Bezdek, Aesch (CH); Pierre Ueberschlag, Saint-Louis (FR)

(73) Assignee: ENDRESS + HAUSER FLOWTEC AG, Reinach (CH)

( * ) Notice: Subject to any disclaimer, the term of this patent is extended or adjusted under 35 U.S.C. 154(b) by 0 days.

(21) Appl. No.: 15/555,714

(22) PCT Filed: Feb. 15, 2016

(86) PCT No.: PCT/EP2016/053092
§ 371 (c)(1),
(2) Date: Sep. 5, 2017

(87) PCT Pub. No.: WO2016/142127
PCT Pub. Date: Sep. 15, 2016

(65) Prior Publication Data

US 2018/0061390 A1 Mar. 1, 2018

(30) Foreign Application Priority Data

Mar. 10, 2015 (DE) ..... 10 2015 103 486

(51) Int. Cl.
*G10K 1/08* (2006.01)
*G10K 1/066* (2006.01)
(Continued)

(52) U.S. Cl.
CPC ..... *G10K 11/04* (2013.01); *G10K 1/066* (2013.01); *G10K 1/08* (2013.01); *G10K 11/002* (2013.01)

(58) Field of Classification Search
CPC ..... G10K 11/002; G10K 1/08; G10K 11/04; A61B 5/02007; A61B 8/06; A61B 8/12;
(Continued)

(56) References Cited

U.S. PATENT DOCUMENTS

2003/0164661 A1* 9/2003 Pfeifer ..... G01F 1/662 310/334
2006/0224298 A1* 10/2006 Lang ..... G01F 1/72 701/114
(Continued)

FOREIGN PATENT DOCUMENTS

DE 10 2008 033 098 A1 1/2010
DE 10 2010 064 117 A1 6/2012
(Continued)

OTHER PUBLICATIONS

German Search Report, German PTO, Munich, dated Dec. 12, 2015.
International Search Report, EPO, The Netherlands, dated Jun. 3, 2016.

*Primary Examiner* — Curtis A Kuntz
*Assistant Examiner* — Julie X Dang
(74) *Attorney, Agent, or Firm* — Bacon & Thomas, PLLC

(57) ABSTRACT

An arrangement comprising an ultrasonic transducer and a damping element with a longitudinal axis, which damping element connects the ultrasonic transducer with a housing- or measuring tube wall. The transducer has an end piece with a medium-contacting surface, from which ultrasonic signals are transferred into a gaseous or liquid medium. The damping element has at least two annular grooves and an annular mass segment arranged therebetween, characterized in that the damping element has a first eigenfrequency, in which the
(Continued)

A annular mass segment executes an axial movement parallel to the longitudinal direction of the damping element. This first eigenfrequency is the highest eigenfrequency, in the case that a plurality of eigenfrequencies are present, in the case of which the annular mass segment executes an axial movement parallel to the longitudinal direction of the damping element, and the damping element has a second eigenfrequency, in which the annular mass segment executes a rotary movement. This second eigenfrequency is the lowest eigenfrequency, in the case that a plurality of eigenfrequencies are present, in the case of which the annular mass segment executes a rotary movement, will and wherein the ratio of the first eigenfrequency to the second eigenfrequency is less than 0.75; and a field device of process measurements technology.

9 Claims, 6 Drawing Sheets

(51) Int. Cl.
*G10K 11/00* (2006.01)
*G10K 11/04* (2006.01)

(58) Field of Classification Search
CPC ..... A61B 8/14; A61B 8/4427; A61B 8/445; A61B 8/4461; A61B 8/4483
USPC ..... 381/353; 1/1; 310/12.08, 12.16, 12.24
See application file for complete search history.

(56) References Cited

U.S. PATENT DOCUMENTS

2009/0289528 A1* 11/2009 Voss ..... B06B 3/00 310/351
2010/0011866 A1 1/2010 Van Klooster
2011/0061452 A1* 3/2011 King ..... G01Q 60/32 73/105
2011/0080803 A1* 4/2011 Vu ..... G01V 1/46 367/32
2012/0272923 A1* 11/2012 Stephens ..... A01K 15/021 119/719

FOREIGN PATENT DOCUMENTS

DE 10 2015 103 486 A1 9/2016
EP 1 340 964 A1 9/2003
EP 1 340 964 B1 9/2003

* cited by examiner

A

A-n

A-a2

A-r1

ARRANGEMENT AND FIELD DEVICE OF PROCESS MEASUREMENTS TECHNOLOGY

TECHNICAL FIELD

The present invention relates to an arrangement including an ultrasonic transducer and a damping element, and to a field device of process measurements technology

BACKGROUND DISCUSSION

An arrangement of an ultrasonic transducer with a filter element is known from European Patent, EP 1 340 964 B1. Such arrangement includes a signal radiating bending plate, which feeds body sound from its edge into the filter element. In this way, the ultrasonic signal is, indeed, centered in the middle; however, the radiating area is very small. The effective total structure of the arrangement in this publication has additionally a frequency spectrum, in which rotation- and axial modes lie very near to one another and below a frequency range of 80000 Hz, the usual frequency range of the wanted signal. This means that the choice of the frequency for the wanted signal is extremely limited or one must compensate measurement error brought about by the eigenfrequencies.

SUMMARY OF THE INVENTION

Starting from this state of the art, it is an object of the present invention to provide an arrangement with a broad frequency range for the wanted signal, without that a compensation of a measurement error then becomes necessary.

The present invention achieves this object by an arrangement including an ultrasonic transducer and a damping element, e.g. a bandpass filter, with a longitudinal axis L. An ultrasonic transducer in this regard is not limited exclusively to piezoelements or other ultrasound producing elements, but, instead, can also include the region of the arrangement, which the ultrasonic signal must traverse before entry into the medium. This can include e.g. one or more coupling layers or matching layers. Especially preferably, e.g. a metal end piece can be part of the ultrasonic transducer, from which an ultrasonic signal is transferred into a gaseous or liquid medium. Especially preferably, this metal end piece is joined with the damping element.

Furthermore, according to the invention, the damping element connects the ultrasonic transducer with a housing- or measuring tube wall. The wall is, however, not part of the arrangement. The transducer includes an end piece having a medium-contacting surface.

From such surface, ultrasonic signals are transferred into a gaseous or liquid medium. This can be, in the case of a flow measuring device, a measured medium or, in the case of fill level measurement, e.g. air.

The damping element has at least two annular grooves and an annular mass segment arranged therebetween. An annular mass segment is an annularly encircling protrusion. In a preferred embodiment, the annular mass segment has always the same wall thickness along its periphery.

Furthermore, according to the invention, the damping element has a first eigenfrequency $f_a$, in which the annular mass segment executes an axial movement parallel to the longitudinal direction of the damping element. This can also be named the axial mode. In case the damping element has a number of axial modes, then the first eigenfrequency is the highest eigenfrequency, in the case of which the annular mass segment executes an axial movement parallel to the longitudinal direction of the damping element.

Additionally, the damping element has according to the invention a second eigenfrequency $f_r$, in which the annular mass segment executes a rotational movement, preferably around its center of mass. This can also be called the rotational mode. In case the damping element has a number of rotational modes, then the first eigenfrequency is the lowest eigenfrequency, in the case of which the annular mass segment executes a rotational movement.

The ratio of the first eigenfrequency $f_a$ to the second eigenfrequency $f_r$ is less than 0.75 according to the invention.

This arrangement enables a selection of the wanted frequency over a very broad frequency range.

Advantageously, the ratio of the first eigenfrequency $f_a$ to the second eigenfrequency $f_r$ is less than 0.55, especially preferably less than 0.4.

Further advantageously, the damping element has at least in the region of a first of the at least two annular grooves a first average separation $r_2$ from the outer wall of a hollow cylindrical portion to the longitudinal axis L. The averaging of the separation relates to a separation averaged over the periphery and the length of the annular groove. Thus, individual regions can deviate from the average value.

The damping element includes at least in the region of the first of the at least two annular grooves a second average separation $r_1$ from the inner wall of the hollow cylindrical portion to the longitudinal axis L. Also, in such case, the averaging of the separation concerns a separation of the inner wall to the longitudinal axis averaged over the periphery and the length of the annular groove.

Moreover, the annular mass segment has between the two annular grooves a certain length $l_3$ in the axial direction. This length is likewise averaged over the length and the periphery.

These variables are combined in a mathematical expression and related to one another. It is, in such case, advantageous, when this expression $$\frac{0.093(r_2 - r_1)}{1\ \text{mm}} + 0.0016[(l_3/1\ \text{mm}) - 12.5]^2 + 0.057$$

evaluates to less than 0.55, especially preferably less than 0.40. The data for $r_1$, $r_2$ and $l_3$ are in millimeters.

This structural coordination of individual segments of the damping element leads to a further optimizing of the frequency spectrum of the arrangement.

Additionally advantageously, the hollow-cylindrical portion is rotationally symmetric. This provides a uniform loading and canceling of body sound.

Advantageously, the ultrasonic transducer and the damping element are connected with one another by material bonding. There are, indeed, also screw variants known for ultrasonic transducers and damping elements; these can, however, loosen or deform when oscillated long enough and are, most often, not hygienic.

Further advantageously, the damping element has less than 5 annular grooves. An increasing number of annular grooves means an increasing danger of weak points, which can fail when exposed to compressive loadings and body sound oscillations.

Advantageously, the length of the at least two annular grooves is equally long in the axial direction and the length of the annular mass segment is greater, preferably at least 1.5 times greater, than the length of one of the two annular grooves. By providing the annular mass segment over a large longitudinal region, the body sound can be better erased and at the same time a better splitting between axial modes and rotational modes occurs in the frequency spectrum.

Advantageously, the ultrasonic transducer has terminally a bending plate, which has a surface, from which the ultrasonic signal is transferred into the medium, which bending plate is embodied to freely oscillate at the edges. In European Patent, EP 1 340 964 B1, the bending plate is described as a plate with the surface, from which the ultrasonic signal is radiated into a medium. In contrast to European Patent, EP 1 340 964 B1, there is in the case of this embodiment no edge feeding of body sound by a bending plate into the damping element, but, instead, the edge of the bending plate freely oscillates. In this way, the ultrasonic signal can be transferred in advantageous manner from a large surface into the gaseous or liquid medium.

Advantageously, the arrangement has in a frequency range, in which the ratio of the wanted frequency to the first eigenfrequency is greater than 1.6 and in which the ratio of the wanted frequency to the second eigenfrequency is less than 0.7, no axial or rotational eigenfrequency. The arrangement can have no axial or rotational eigenfrequency especially in the region between 50000 and 120000 Hz.

A field device of the invention for process measurements technology, especially an ultrasonic, flow measuring device for measuring gaseous media, includes a measuring tube, on which an arrangement as claimed in claim 1 is placed.

Alternatively, the arrangement can also be applied in a fill-level measuring device, wherein the measuring tube is, in such case, however, most often, replaced by a supply container—e.g. a tank or a silo.

The arrangement can also be used for other field devices from the field of process measurements technology.

BRIEF DESCRIPTION OF THE DRAWINGS

The present invention will now be explained in greater detail based on the appended drawings.

The figures of the drawing show as follows.

DETAILED DISCUSSION IN CONJUNCTION WITH THE DRAWINGS

The present arrangement can be applied both in the case of fill level measuring devices as well as also in the case of flow measuring devices. In the following, however, the construction, operation and advantages resulting therefrom will be described primarily for an ultrasonic, flow measuring device. The arguments can, however, for the most part, also be transferred to ultrasonic, fill level measurement.

Ultrasonic, flow measuring devices are widely applied in process and automation technology. They permit simple determination of volume flow and/or mass flow of a measured medium in a pipeline. Known ultrasonic, flow measuring devices frequently work according to the travel-time difference principle. In the travel-time difference principle, the different travel times of ultrasonic waves, especially ultrasonic pulses, so-called bursts, are evaluated relative to the flow direction of the liquid. For this, ultrasonic pulses are sent at a certain angle to the tube axis both with as well as also counter to the flow. From the travel-time difference, the flow velocity, and therewith, in the case of known diameter of the pipeline section, the volume flow, can be determined.

Ultrasonic waves are produced and received with the assistance of so-called ultrasonic transducers. For this, ultrasonic transducers are solidly connected with the tube wall of the relevant pipeline section. This device type is known to those skilled in the art also as an inline, flow measurement device. Also clamp-on ultrasonic, flow measuring systems exist, which are placed, e.g. secured, externally on the measuring tube. Clamp-on ultrasonic, flow measuring devices are, however, not subject matter of the present invention Ultrasonic transducers normally include an electromechanical transducer element, e.g. one or more piezoelectric elements.

Both in the case of clamp-on-systems, as well as also in the case of inline-systems, the ultrasonic transducers are arranged in a shared plane on the measuring tube, either on oppositely lying sides of the measuring tube, in which case the acoustic signal travels, projected on a tube cross section, once along a secant through the measuring tube, or on the same side of the measuring tube, in which case the acoustic signal is reflected on the oppositely lying side of the measuring tube, whereby the acoustic signal traverses the measuring tube twice along the secant projected on the cross section through the measuring tube.

Figure 1:
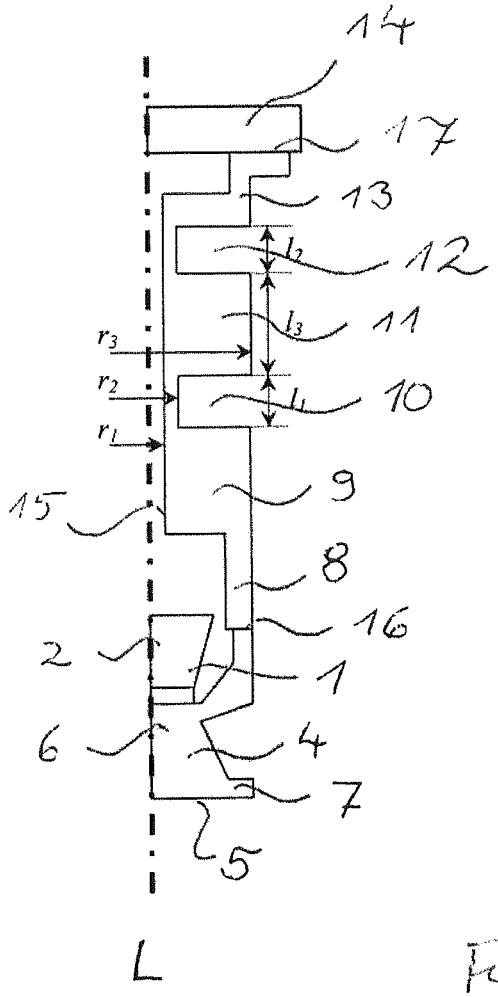
FIG. 1 is an arrangement of the invention comprising an ultrasonic transducer and a damping element.

In the concrete example of an embodiment of FIG. 1, an arrangement with a corresponding ultrasonic transducer 1 is embodied with two electromechanical transducer elements 2, especially two piezo elements, arranged on top of one another. The ultrasonic transducer 1 includes additionally an end piece 4 with a medium-contacting surface 5. At this surface 5, the ultrasonic waves produced by one or more electromechanical transducer elements 2 are transferred to the measured medium.

The end piece 4 shown in FIG. 1 includes a pedestal 6, which is in contact, especially in shape-interlocking contact, with the electromechanical transducer elements 2. Furthermore, the end piece 4 includes a bending plate 7 with the medium-contacting surface 5.

The pedestal 6 of the end piece 4 includes an interface 16 to a damping element 15. This damping element 15 is embodied as a cylindrical body with at least two annular grooves 10 and 12 extending parallel to one another. Interface 16 can be embodied e.g. as a welded connection.

Arranged between the interface 16 and a first of the two annular grooves 10 is a first annular mass segment 9, which has a greater wall thickness, especially at least two times thicker, than the annular groove 10.

Arranged between the two annular grooves 10 and 12 is additionally a second annular segment 11, which has a greater wall thickness, especially at least two times thicker, then the annular grooves 10 and 12.

As evident from FIG. 1, the damping element 15 is essentially defined by three radii. There is a first radius $r_1$, which extends from a longitudinal axis L of the damping element 15 to an inner wall of the cylindrical body. Furthermore, a second radius $r_2$ is provided, which describes the separation of the outer wall from the longitudinal axis in the region of the annular grooves 10, 12. Finally, there is a third radius $r_3$, which describes the radial separation between the longitudinal axis and the outermost point of the second annular mass segment 11.

After the second annular groove 12, the damping element 15 is connected via an interface 17 in the region of the third radius $r_3$ with a housing wall 14. Also here, the interface 17 can be embodied as a welded connection. The interface is arranged in FIG. 1 radially outside of the second radius $r_2$ and in the region of the third radius $r_3$.

The annular grooves 10 and 12 extend over length sections $l_1$ and $l_2$, respectively, along the longitudinal axis L. These length sections $l_1$ and $l_2$, are dimensioned equally large in FIG. 1. The second annular mass segment 11 extends over a length section $l_3$, which in the example of an embodiment of FIG. 1 is greater than the length of sections $l_1$ and $l_2$.

The first annular mass segment 9 is connected at its radially outermost point with an annular segment 8, which extends from the interface 16 to the annular mass 9. This annular segment 8 has a smaller wall thickness than that of the first annular mass segment 9. Preferably, it is at least twice as small.

The annular mass segment 9 transitions at its radially innermost point into the annular groove. In this way, there occurs in the case of an axial force a diversion of this force through the annular mass segment from the outside to the inside.

Figure 2:
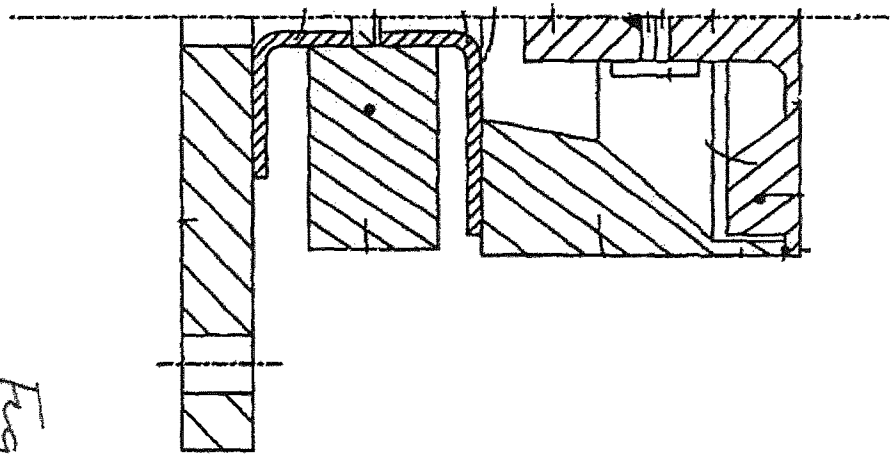
FIG. 2 is an arrangement according to the state of the art.

FIG. 2 shows a damping element from the state of the art as exemplified by EP 1 340 964 B1. The damping characteristics of this damping element were examined and compared with the damping characteristics of the arrangement of FIG. 1.

Figure 3:
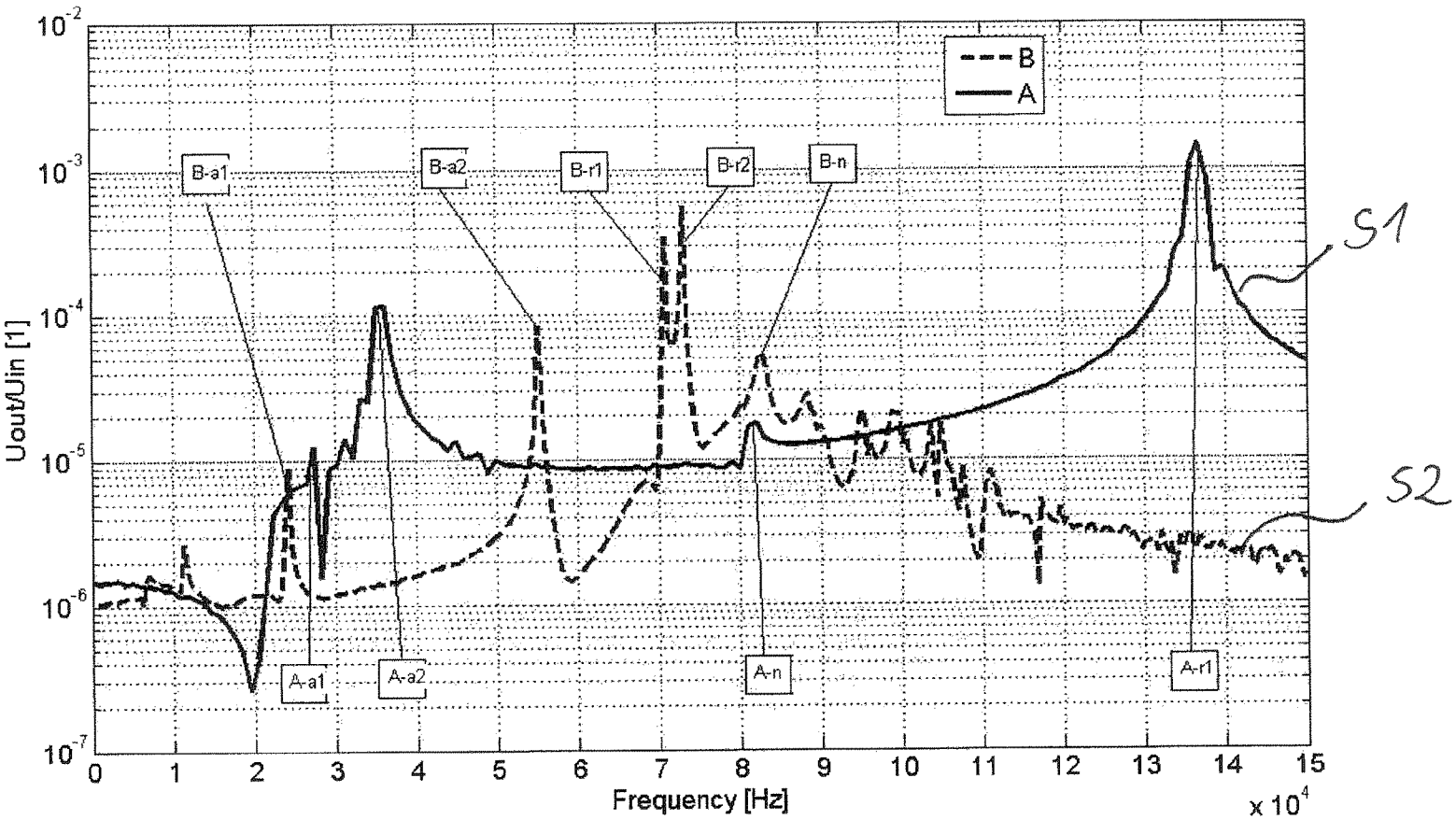
FIG. 3 is a frequency spectrum of the arrangement of FIG. 1 and the arrangement according to FIG. 2.

FIG. 3 shows the damping behavior of the arrangement of FIG. 1 based on the spectrum S1 with the solid line oscillation spectra in comparison with the spectrum S2 with the dashed line for the damping characteristics of the arrangement of FIG. 2.

A wanted signal A-n, which is required for determining the fill level or the flow, lies in the spectrum S1 at, for instance, 82000 Hz. As can be seen from FIG. 3, the frequency range of the wanted signal A-n for the arrangement of FIG. 1 can be selected in a very broad region. The frequency range of the wanted signal can be in the range from 45000 to, for instance, 120000 Hz, without experiencing greater superimposings of the wanted signal A-n with the eigenfrequencies A-a1, A-a2, A-r1 of the damping element 15. The peaks in the spectrum S1 at 28000 and at 35000 Hz represent axial oscillations, while the peak at, for instance, 136000 Hz is a rotary oscillation.

In contrast, the spectrum of the damping element of FIG. 2 has, in the case of to scale conversion, an entire series of eigenoscillations, which superimpose on a wanted signal at, for instance, 82000 Hz. The peaks at 25000 and at 55000 Hz represent, in such case, axial oscillations B-a1 and B-a2. The peaks at 71000 and 73000 Hz represent, in contrast, rotational oscillations B-r1 and B-r2. Both the axial—as well as also the rotational oscillations lie in the case of the variant illustrated in FIG. 3 below the wanted frequency of 82000 Hz.

Figure 4:
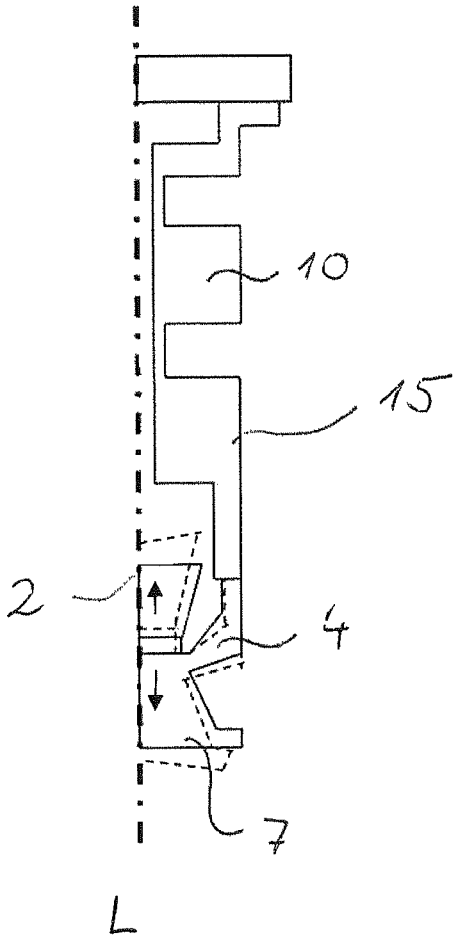
FIG. 4 is a representation of the oscillatory behavior of the arrangement of the invention at an excitation frequency in the case of the wanted frequency.

FIG. 4 shows the oscillatory behavior of the damping element in the case of sending and/or receiving an ultrasonic signal in the wanted frequency range. One can see that primarily the ultrasonic transducer 1, thus the electromechanical transducer elements 2 and 3 and the end piece 4 with the pedestal 6 and the bending plate 7, are oscillating. The bending plate 7 undergoes during operation of the ultrasonic flow device a radial deflection A1. This deflection A1 is, however, not transferred to a following damping structure, but, instead, the bending plate 7 oscillates freely and is not disturbed in its radial deflection by a damping structure. In this way, the radiated ultrasonic signal transfers especially well and unimpeded to the medium.

Figure 5:
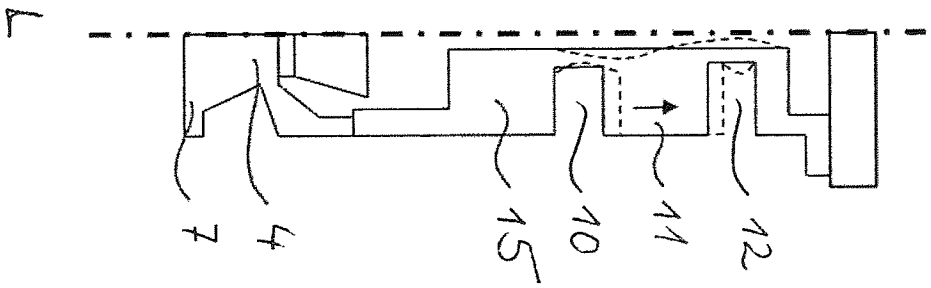
FIG. 5 is a representation of the oscillatory behavior of the arrangement of the invention at an excitation frequency in the region of an axial mode.

FIG. 5 shows the oscillatory behavior of the arrangement of the invention in the illustrated embodiment according to FIG. 1 in the state of the eigenfrequency A-a2 (axial mode at about 35000 Hz.). Primarily, the annular mass segment 11 executes an axial movement between the two parallel annular grooves 10 and 12. The back and forth movement of the annular mass segment 11 results in a temporary material wall deformation in the region of the annular grooves 10 and 12 in the form of a temporary thinning or thickening.

Figure 6:
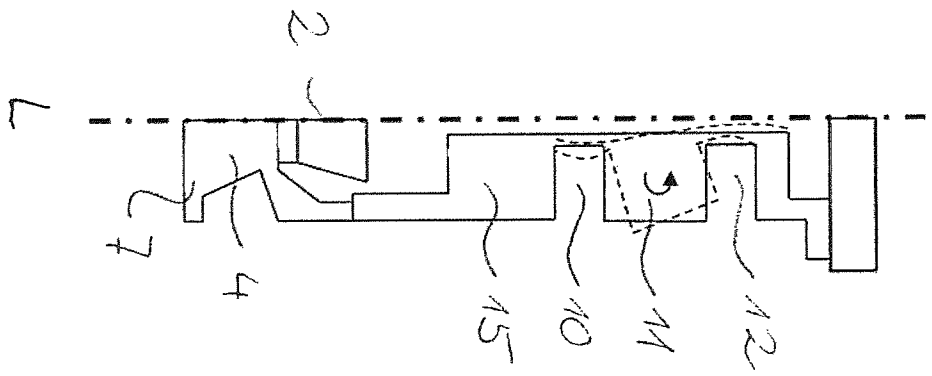
FIG. 6 is a representation of the oscillatory behavior of the arrangement of the invention in the case of an excitation frequency in the region of a rotational mode.

FIG. 6 shows the oscillatory behavior of the arrangement of the invention in the illustrated embodiment according to FIG. 1 in the state of the eigenfrequency A-r1 (rotational mode at about 137000 Hz.). Primarily, the annular mass segment 11 executes a rotary movement between the two parallel annular grooves 10 and 12. The oscillatory movement of the annular mass segment 11 causes a temporary material wall deformation in the region of the annular grooves 10 and 12 in the form of a wave shaped bending of the material wall.

The embodiment shown in FIG. 1 can also be further modified in the context of invention. Thus, instead of a cylindrical basic structure, also a prismatic basic structure, preferably with unitary prism surfaces, provides an option. Also, individual segments of the basic structure, thus especially also the annular mass segment 11, can be embodied polygonally in two-dimensional section perpendicular to the longitudinal axis L.

Due to the sequence of annular mass segments 9 and 11 and annular grooves 10 and 12, a decoupling of the one or more rotational modes from the axial modes can be achieved, so that a broad frequency range between these individuals eigenfrequencies is available for the wanted signal.

On the whole, the arrangement can be of one- or multipiece construction. The damping element and the end piece are rotationally symmetric and are of metal. In such case, the end piece can preferably be of stainless steel or titanium. The damping element is preferably composed of stainless steel.

The invention claimed is:

1. An arrangement, comprising:

an ultrasonic transducer; and a damping element with a longitudinal axis, which damping element connects said ultrasonic transducer with a housing- or measuring tube wall, wherein:

said ultrasonic transducer has an end piece with a medium-contacting surface, from which ultrasonic signals are transferred into a gaseous or liquid medium;

said damping element has at least two annular grooves and an annular mass segment arranged therebetween;

said damping element has a first eigenfrequency, in which said annular mass segment executes an axial movement parallel to the longitudinal direction of said damping element;

this first eigenfrequency is the highest eigenfrequency, in the case that a plurality of eigenfrequencies are present, in the case of which said annular mass segment executes an axial movement and said damping element has a second eigenfrequency, in which the annular mass segment executes a rotary movement;

this second eigenfrequency is the lowest eigenfrequency, in the case that a plurality of eigenfrequencies are present, in the case of which said annular mass segment executes a rotary movement; and the ratio of the first eigenfrequency to the second eigenfrequency is less than 0.75;

wherein:

said damping element has at least in the region of a first of the at least two annular grooves a first average separation from the outer wall of a hollow cylindrical portion to the longitudinal axis;

said damping element has at least in the region of the first of the at least two annular grooves a second average separation from the inner wall of the hollow cylindrical portion to the longitudinal axis;

said damping element has in the region of the annular mass segment between the annular grooves an average length, wherein the expression $$\frac{0.093(r_2 - r_1)}{1\ \text{mm}} + 0.0016[(l_3/1\ \text{mm}) - 12.5]^2 + 0.057$$

is less than 0.55, wherein the data for r1, r2 and l3 are in millimeters.

2. The arrangement as claimed in claim 1, wherein:

the ratio of the first eigenfrequency to the second eigenfrequency is less than 0.55.

3. The arrangement as claimed in claim 1, wherein:

said hollow-cylindrical portion is rotationally symmetric.

4. The arrangement as claimed in claim 1, wherein:

said ultrasonic transducer and said damping element are connected with one another by material bonding.

5. The arrangement as claimed in claim 1, wherein:

said damping element has less than five annular grooves.

6. The arrangement as claimed in claim 1, wherein:

the lengths of said at least two annular grooves in the axial direction are equally long and the length of said annular mass segment is greater than the length of one of said two annular grooves.

7. The arrangement as claimed in claim 1, wherein:

said ultrasonic transducer has terminally a bending plate, which has said medium-contacting surface, from which the ultrasonic signal is transferred into the medium, which bending plate is embodied edgewise to freely oscillate.

8. The arrangement as claimed in claim 1, wherein:

the arrangement has in a frequency range, in which the ratio of the wanted frequency $f_n$ to the first eigenfrequency $f_a$ is greater than 1.6 and in which the ratio of the wanted frequency $f_n$ to the second eigenfrequency $f_r$ is less than 0.7, no axial eigenfrequency or rotational eigenfrequency.

9. An ultrasonic, flow measuring device for measuring gaseous media, wherein the ultrasonic flow device has a measuring tube or a supply container, on which an arrangement as claimed in claim 1 is placed, said arrangement comprises: an ultrasonic transducer; and a damping element with a longitudinal axis, which damping element connects said ultrasonic transducer with a housing- or measuring tube wall, wherein: said ultrasonic transducer has an end piece with a medium-contacting surface, from which ultrasonic signals are transferred into a gaseous or liquid medium said damping element has at least two annular grooves and an annular mass segment arranged therebetween; said damping element has a first eigenfrequency, in which said annular mass segment executes an axial movement parallel to the longitudinal direction of said damping element; this first eigenfrequency is the highest eigenfrequency, in the case that a plurality of eigenfrequencies are present, in the case of which said annular mass segment executes an axial movement and said damping element has a second eigenfrequency, in which the annular mass segment executes a rotary movement; this second eigenfrequency is the lowest eigenfrequency, in the case that a plurality of eigenfrequencies are present, in the case of which said annular mass segment executes a rotary movement; and the ratio of the first eigenfrequency to the second eigenfrequency is less than 0.75.

* * * * *